US008747957B2

(12) United States Patent
Gruen et al.

(10) Patent No.: US 8,747,957 B2
(45) Date of Patent: Jun. 10, 2014

(54) COMPONENT HAVING COATING AND COATING METHOD

(75) Inventors: Mathias Gruen, Lauingen (DE); Dietmar Voelkle, Biberach (DE); Benedict Michelis, Erbach (DE); Florian Hesselbach, Blaustein (DE)

(73) Assignee: Diehl Aircabin GmbH, Laupheim/Brd (DE)

( * ) Notice: Subject to any disclaimer, the term of this patent is extended or adjusted under 35 U.S.C. 154(b) by 157 days.

(21) Appl. No.: 12/906,453

(22) Filed: Oct. 18, 2010

(65) Prior Publication Data

US 2011/0097544 A1 Apr. 28, 2011

(30) Foreign Application Priority Data

Oct. 24, 2009 (DE) ..... 10 2009 050 601

(51) Int. Cl.
*B05D 1/06* (2006.01)
*B05D 1/34* (2006.01)
*B05D 3/02* (2006.01)

(52) U.S. Cl.
USPC ..... 427/469; 427/466; 427/470; 427/258; 427/493

(58) Field of Classification Search
USPC ..... 427/466, 469, 470, 258, 493
See application file for complete search history.

(56) References Cited

U.S. PATENT DOCUMENTS

| | | | | |
|---|---|---|---|---|
| 4,554,959 | A * | 11/1985 | Smedberg | 144/380 |
| 5,599,591 | A * | 2/1997 | Shiraiwa | 427/458 |
| 5,792,558 | A * | 8/1998 | Jonas et al. | 428/419 |
| 6,599,576 | B1 * | 7/2003 | Leach | 427/375 |
| 2007/0281177 | A1 * | 12/2007 | Haubrich et al. | 428/457 |
| 2008/0075859 | A1 * | 3/2008 | Baker et al. | 427/275 |
| 2009/0181180 | A1 | 7/2009 | Poullos | |

FOREIGN PATENT DOCUMENTS

| | | | |
|---|---|---|---|
| DE | 10 2004 044 655 | A1 | 3/2006 |
| DE | 10 2006 048 092 | A1 | 4/2008 |

* cited by examiner

*Primary Examiner* — Frederick Parker
(74) *Attorney, Agent, or Firm* — Scully, Scott, Murphy & Presser, P.C.

(57) ABSTRACT

A coating method wherein in order to simplify the coating method and increase the flexibility thereof with respect to respective desired coatings, provision is made that a powder lacquer layer (3) is applied to a surface (2) of the component (1), and an imprint (4) is applied to the powder lacquer layer (3), preferably by an inkjet method.

6 Claims, 1 Drawing Sheet

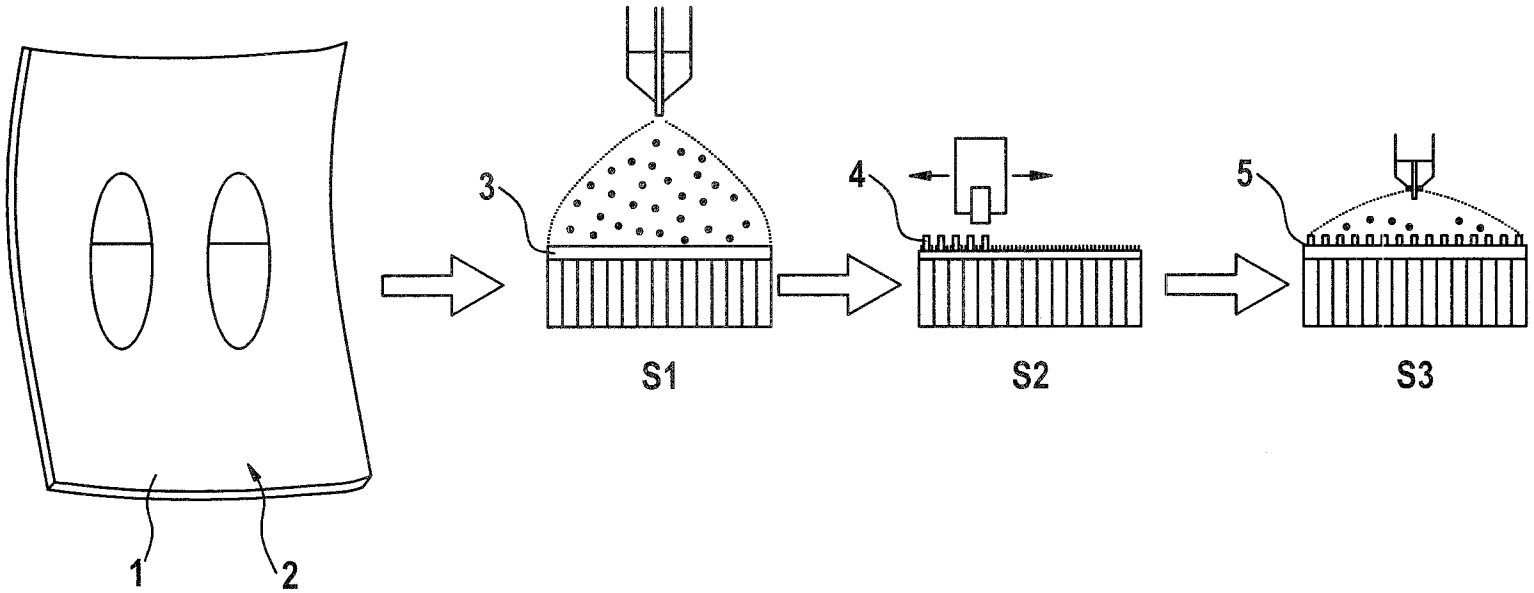
S1
S2
S3
1
2
3
4
5

COMPONENT HAVING COATING AND COATING METHOD

BACKGROUND OF THE INVENTION

The invention relates in particular to a component provided with a coating, as well as an associated coating method.

The component can be in particular a cabin component, in particular an internal panelling element or internal panelling component of the cabin of an aircraft. In particular in the case of internal panelling components it is often desirable to provide them with an individual decoration. The decoration is not only restricted to an individual colour design, but rather can comprise specified three-dimensional surface structures or textures.

DISCUSSION OF THE PRIOR ART

The colour design in the case of internal panelling elements for cabins of aircraft can be produced by application of coloured lacquers in a known manner. Furthermore, the respective desired colour design can also be achieved by application, for example, lamination, of an appropriately coloured designed film.

To generate surface structures, a corresponding textured film or film having a pattern is typically laminated onto the internal panelling element.

A disadvantage of the lacquer is that textures or three-dimensional surface structures cannot be produced in a simple manner. This applies in particular when locally varying surface structures and textures are to be produced.

A disadvantage with respect to production of the films used for generating the textures is their low flexibility with respect to texture changes. It is thus hardly possible at short notice to produce internal panelling elements having altered or completely different textures or surface structures. The effort for producing altered films often results in delivery times of up to 8 weeks. Notwithstanding this, if films are used, it is necessary to keep the respective films available in a sufficient number for each individual colour design and/or texture or surface design, i.e., for each single individual decoration. This requires a comparatively high storage outlay, connected with comparatively high storage costs.

SUMMARY OF THE INVENTION

Proceeding therefrom, it is an object of the invention to remedy the disadvantages according to the prior art.

This object is achieved by the independent claims. Advantageous embodiments result from the dependent claims.

A first aspect of the invention relates to a coating method for a component, which can be in particular a cabin component for aircraft, in particular an internal panelling element or internal panelling component for cabins of an aircraft. The coating method comprises the following steps in sequence:

a) applying a powder lacquer layer to at least one surface of the component and b) applying an imprint to the powder lacquer layer.

In the proposed method, the respective desired individual texture or three-dimensional surface structure or composition of the component can be achieved by appropriate application of the powder lacquer layer. Coloured designs which form the individual decoration together with the texture may be generated by printing using corresponding inks, for example, in the inkjet method.

In contrast to film-based methods according to the prior art, three-dimensional surface structure, texture, and colour are not generated in an upstream process in the present method, but rather directly on the component. This has the advantage that alterations in texture and colour, or in general in the individual decoration, may be implemented comparatively rapidly, at short notice, and easily, without excessively long lead times being required, as is the case in the event of coating using films, for example.

The respective desired colouring can be implemented by a corresponding coloured imprint, for example, in the inkjet method. The imprint can be implemented as fully covering or, with incorporation of the paint of the powdered lacquer layer as the basic colour tone, as partially covering.

Textures and three-dimensional surface structures may be achieved by corresponding application of one or more suitable, in particular texturing powder lacquers or powder lacquer layers.

This shows that the coating method according to the invention has especially high flexibility in particular with respect to changes in the texture and colouring, i.e., in the individual decor. To produce a coated component having altered texture, it is only necessary to apply the powder lacquer layer in accordance with the altered texture, which is possible at short notice and without long lead times. This is similarly true for the respective colour design.

Furthermore, the comparatively high storage costs, which occur with film-based coating methods as noted at the beginning, are dispensed with. Moreover, automation advantages result in that the proposed method can be implemented in a simple manner in an in-line process. Processing times and, connected thereto, the coating costs may thus be reduced in particular. Processing logistic advantages also result. This is because with film-based methods, the provision of the respective correct films in a sufficient quantity at the coating location, in particular coordinated in time, and the storage and retrieval of the respective films connected thereto represents a significant processing-logistic outlay.

A further advantage of the method according to the invention is the weight reduction, which is especially advantageous in particular in the case of components for aircraft. A weight reduction of up to 50% or more can be achieved in relation to film-coated components with respect to the individual decoration, and a weight reduction of up to 20% or more can be achieved in relation to typical lacquered components.

To protect from external effects, a protective layer can be applied to the printed powder lacquer layer. The protective layer can be, in particular, a nanolayer, i.e., a layer having a thickness in the nanometer range or having embedded nanoparticles, and/or a preferably transparent lacquer layer. Using the protective layer, in particular the printed powder lacquer layer lying underneath can be protected from external effects. In addition, upon suitable selection of the material and the composition of the protective layer, for example, the cleaning capability, the hardness, the scratch resistance, and/or the abrasion resistance can be improved. As already noted, the protective layer is preferably transparent, so that decoration provided using the printed powder lacquer layer, in particular in the colour impression, is distorted as little as possible. However, it is not precluded in the scope of the invention that the protective layer is used for the purpose of intentionally influencing or changing the original colour impression of the printed powder lacquer layer. This opens up the possibility of implementing a broader palette of coloured designs.

The powder lacquer layer, the imprint, and/or the protective layer may be dried or cured by application of hot air, for example, in a circulating air oven, using infrared radiation, and/or using ultraviolet radiation. These drying methods may be implemented in particular in an in-line process having corresponding time and cost advantages.

The powder lacquer layer is preferably applied to the surface according to an electrostatic powder coating method. This presumes that the component has at least superficial electrically conductive properties. Electrically conductive properties may be achieved, for example, by applying a conductive lacquer and/or a conductive priming compound to the component. The electrically conductive properties may result from conductive resin compositions and/or conductive fibres, in particular carbon fibres, which are used during the production of the component. The latter can be implemented easily in particular in the case of composite material lightweight components made of resin-impregnated prepregs and/or carbon-fibre-reinforced materials. It must only be ensured that the resin compositions and/or conductive fibres are located and/or come to rest in a suitable manner and in a sufficient quantity on the surface of the component, so that sufficient electrically conductive properties for the powder coating result. The above-mentioned lightweight components are used in particular in the aerospace industry because of the thus achievable weight reduction.

In contrast to film-based methods, the method according to the invention can be applied to nearly arbitrarily shaped and curved components, for example, by gantry facilities or robot-supported coating and lacquering facilities.

Overall, it has been shown that the method according to the invention achieves the objects on which the invention is based.

A second aspect of the invention relates to a component, in particular a cabin component for aircraft, such as an internal panelling element for aircraft cabins. The component has a substrate having a powder lacquer layer applied to a surface, in particular to generate a specified texture, i.e., a specified three-dimensional surface structure or topology of the surface. An imprint is applied to the powder lacquer layer. The imprint can be applied in the inkjet method. The imprint can comprise one or more, in particular colour, printing inks.

Regarding advantages and advantageous effects of the component according to the second aspect of the invention, reference will be made to the statements on the first aspect of the invention.

In addition, it is to be noted that in contrast to the film-based coating, it is possible to coat components having essentially arbitrary three-dimensional shape, i.e., having arbitrary curves and the like. This is possible in particular in that the powder lacquer layer, the imprint, and further layers, such as a protective layer, may be applied automatically, for example, by industrial robots and/or gantry facilities, whose operating sequences and movements may be adapted comparatively simply to altered component geometries.

To protect the printed powder lacquer layer from external effects and to improve the surface composition of the finished component, a protective layer can be applied to the imprint, and/or to the printed powder lacquer layer. This can be implemented in the form of a nanolayer and/or a lacquer layer. The nanolayer can have a thickness of approximately 20 nm, and the lacquer layer can have a thickness of approximately 20 μm. The protective layer can be applied in the spray method, for example, spraying methods operating using hydraulic pressure and/or compressed air coming into consideration. With suitable materials and composition of the protective layer, inter alia, the cleaning capability, scratch resistance, and/or abrasion resistance of the relevant component surface can also be improved.

Corresponding to the method according to the first aspect of the invention, the component can have at least superficial electrically conductive properties. These may be achieved, for example, by an applied conductive lacquer and/or a conductive priming compound. Electrically conductive properties may also be produced by conductive resin compositions and/or conductive fibres, in particular carbon fibres, which are at least superficially located. The latter may be exploited advantageously in the case of composite components, which are produced from resin-impregnated fabrics, in certain circumstances having carbon fibre reinforcement.

Overall, it has been shown that the component according to the second aspect of the invention achieves the object on which the invention is based at least to the same extent as the coating method according to the first aspect of the invention. In particular, it is clear that the coating method according to the invention and the component according to the invention cause a significant increase in flexibility during the production of the fundamental individual decorated components.

BRIEF DESCRIPTION OF THE INVENTION

An exemplary embodiment of the invention is described in greater detail hereafter on the basis of the appended FIGURE.

DETAILED DESCRIPTION OF THE INVENTION

The FIGURE schematically shows individual processing steps for the coating of an internal panelling component 1 for the cabin of a commercial aircraft according to a coating method according to the first aspect of the invention.

It is to be noted that for the coating method described in connection with the FIGURE, no claim is made of completeness, which is to indicate that the coating method can be readily adapted, expanded, and varied in the scope of the invention and above-mentioned general statements. The partial figures contained in the Figures are not necessarily to scale with one another, and scales may vary between individual partial figures. In particular an exemplary embodiment for a component according to the second aspect of the invention, including the properties, advantages, and advantageous effects, results from the description of the coating method.

The internal panelling component 1 is curved according to the desired inner shape of the cabin, and has two recesses provided for installation of inner window units. The internal panelling component 1 is a component produced from carbon fibre composite materials. However, arbitrary other composite materials, fibre composite materials, in particular glass-fibre composite materials, as well as thermoplastics, thermosets, and other lightweight construction materials, in particular of the aerospace industry, come into consideration.

In the film-based coating methods known according to the prior art, the curvature of the internal panelling component 1 and the recesses require a significant effort during the positioning and orientation of the film precisely in location. Furthermore, the danger of corrugation and wrinkling arises upon application of the film to the curved surface. Notwithstanding this, the film-based methods have the disadvantage that films of the particular desired decoration must be kept ready in a sufficient quantity. This results, on the one hand, in substantial storage costs, connected with a comparatively high outlay for the provision of the films at the respective production or coating location. In addition, film-based coating methods display little flexibility, when the respective decoration is to be altered, and/or the internal panelling element is to be provided with an entirely different decoration. The latter is true in particular also for methods according to the prior art, in which the decoration, i.e., the colour design and—if at all possible—the texture is generated by lacquer layers.

In particular these disadvantages may be prevented using the coating method according to the invention, as shown from the following statements.

In a first step S1, a powder lacquer layer 3 is applied to the internal panelling component 1, at least to the surface 2, which faces toward the cabin interior upon correct installation. The application of the powder lacquer layer 3, i.e., the powder coating, is performed according to an electrostatic method. Such a method presumes that the surface 2 is sufficiently conductive. This is ensured in the present case by carbon fibres of the carbon fibre composite material which are located on the surface 2. To further increase the electrical conductivity, further conductive resins, conductive lacquers, conductive priming compounds, or other materials may be used at or on the respective surface 2. These are suitable in particular in the case of fibre composite materials having electrically nonconductive fibres, such as glass-fibre composite materials.

The powder lacquer layer 3 can be applied manually or automatically, for example, using gantry facilities or robot facilities. In particular in the case of gantry facilities and robot facilities, the tool for applying the powder lacquer can be moved in multiple degrees of movement freedom at high precision, so that the coating of nearly arbitrarily shaped, in particular curved surfaces is possible with high location precision. The powder lacquer layer 3 is applied in such a manner that the texture or three-dimensional surface structure required for the respective decoration is provided by the powder lacquer layer 3 per se. In particular, the texture or three-dimensional surface structure can be produced with high precision and reproducibility using the automated method. The respective desired texture implementation can be achieved via the composition of the powder lacquer. Ingredients and/or formulas added to the powder lacquer may be used for this purpose, which result in the occurrence of the texture upon curing of the powder lacquer, for example.

After the application, the powder lacquer layer 3 is cured for 10 minutes, for example, at 130° C. employing infrared radiation in a further intermediate step (not explicitly shown). It is obvious that the duration and temperature and the respective used curing method may be dependent on the type of the respective used powder lacquer. The specified curing parameters are thus only to be understood as exemplary. In addition to the application of infrared radiation, an application of heat, for example, in a circulating air oven, or ultraviolet radiation alternatively or additionally comes into consideration.

After application and curing of the powder lacquer layer 3, the internal panelling component 1 already displays the texture or three-dimensional surface structure required for the respective decoration.

It is to be noted that, inter alia, the entire surface 2 of the internal panelling component 1 does not have to be coated using the powder lacquer layer 3. Such situations may result, for example, if the internal panelling component 1 is only to be sectionally provided with a textured decoration. Stated generally, this means that the surface 2 is at least sectionally or partially provided with a texturing powder lacquer layer 3 in the method according to the invention.

In a second step S2, which follows the curing, the internal panelling component 1, specifically at least the powder lacquer layer 3, is printed according to a colour design resulting from the respective decoration. This is performed in the present exemplary embodiment by an imprint 4 using printing ink(s) in the inkjet method. The imprint 4, in particular in the inkjet method, has the advantage over a lacquering known according to the prior art that the respective colour design can be generated with high precision. Similarly to the application of the powder lacquer layer, the printing heads used for the printing can be moved automatically and computer-controlled using gantry facilities or robot facilities. Significant advantages result in the precision of the imprint 4, among other things both in regard to the location precision of the imprint 4 and also in the precision with respect to the colour locations within the imprint 4. Furthermore, such automated printing displays particularly high flexibility with respect to greatly varying shapes and curves of the internal panelling component 1, which means that nearly arbitrarily shaped and curved internal panelling components 1 may be printed similarly.

After the printing, a drying step (not explicitly shown) follows, in which the imprint 4, specifically the printing ink(s) applied during the printing, may be dried. The drying can be performed by temperature control, for example, by infrared radiation or application of heat in a circulating air oven. It is also possible to dry and/or cure the imprint 4 by application of ultraviolet radiation. The respective processing conditions for drying and curing are extensively dependent on the properties of the used printing ink(s), so that specification of the processing conditions can be dispensed with. However, it is to be noted that a person skilled in the art can readily find suitable processing conditions for drying or curing if the properties of the respective printing inks and the respective substrate, in the present case the powder lacquer layer 3, are known. Furthermore, it is possible for a person skilled in the art, if the respective powder lacquer used is known, to find corresponding compatible printing inks, in particular with respect to adhesion, colour stability, colour locus, wetting, running properties of the printing ink(s), etc. Finally, it is to be noted that post drying or post-curing of the powder lacquer layer 3 can also be performed by the drying or curing of the imprint, possibly in a desired manner.

Similarly to the statements on the powder lacquer layer 3, it is also in the scope of the invention in the case of the imprint 4 if it is solely produced sectionally or partially, e.g., corresponding to the powder lacquer layer 3. Furthermore, it is in the scope of the invention if the internal panelling component 1 receives a base colouration through the powder lacquer layer 3, which is at least partially or sectionally modified or overprinted to generate the colour design of the decoration.

The respective desired individual decoration is finished using the printing. To protect from harmful external effects, such as moisture, mechanical strains, contaminants, etc., a final protective layer 5 can be applied in a third step S3. All types of protective lacquers are suitable for this purpose and, as in the present example, a nanolayer. The composition of the nanolayer is selected in such a manner that an optimum compatibility with the respective substrate and other advantages listed below may be achieved. The nanolayer is applied at a thickness of approximately 20 nm. Other protective lacquers may be applied at layer thicknesses of approximately 20 μm, for sample. The application of the nanolayer—and also other protective layers—can be performed in the spray method. The respective protective layer materials may be atomized by hydraulic pressure (so-called airless method), by compressed air, or by a combination of hydraulic pressure and compressed air (so-called air mix method).

The above-mentioned methods, such as the application of infrared radiation, ultraviolet radiation, and/or circulating air, may be used for drying or curing the protective layer 5, and optionally for post-drying or post-curing the powder lacquer layer 3 and/or the imprint 4. Robot facilities and gantry facilities may also be used with the above-described advantages.

With suitable protective layer materials, in addition to the above-mentioned advantages, further advantageous effects may be achieved, such as increased scratch and abrasion resistance, improved cleaning properties, inter alia.

Further advantages of the coating method according to the invention and of the internal panelling component 1, or the component in general, which have not been mentioned up to this point in the context of the exemplary embodiment, are in the weight reduction as it relates to the individual decoration. Using the procedure according to the invention, weight reductions of up to 50% or more can be achieved in relation to typical decoration films. Weight reductions of up to 20% or more can be achieved in relation to typical lacquering.

Overall, it has been shown that the component according to the invention and the coating method according to the invention achieve the object on which the invention is based.

The invention claimed is:

1. A coating method for a component, comprising:

applying a powder lacquer layer to at least one surface of the component to generate a specified texture, drying or curing the powder lacquer layer, printing on the dried or cured powder lacquer layer to generate an imprint on the powder lacquer layer, and forming a protective layer in the form of a nanolayer to the imprint, wherein the component is provided with electrically conductive properties at the at least one surface of the component, and the applying of the powder lacquer layer comprises applying the powder lacquer layer to the surface in accordance with an electrostatic powder coating process, and wherein carbon fibers are applied to the surface of the component to implement the electrically conductive properties.

2. The coating method according to claim 1, further comprising drying or curing at least one of the imprint and the protective layer by selectively applying at least one of hot air, infrared radiation, and ultraviolet radiation.

3. The coating method according to claim 1, wherein the printing of the powder lacquer layer comprises inkjet-printing the powder lacquer layer to generate the imprint on the powder lacquer layer.

4. The coating method according to claim 2, wherein said at least one of the powder lacquer layer, the imprint, and the protective layer is dried or cured by the application of hot air in a circulating air oven.

5. The coating method according to claim 1, wherein said component comprises a cabin component for an aircraft.

6. The coating method according to claim 1, wherein the drying or curing the powder lacquer layer is implemented by selectively applying at least one of hot air, infrared radiation, and ultraviolet radiation.

* * * * *